US008485107B2

(12) United States Patent
Heyden et al.

(10) Patent No.: US 8,485,107 B2
(45) Date of Patent: Jul. 16, 2013

(54) DEVICES AND SYSTEMS FOR CONTROLLING TRAVEL OF A RAILCAR

(75) Inventors: Thomas J. Heyden, Arlington Heights, IL (US); Gregory P. Reitz, Silver Lake, WI (US); John A. Hooper, Greenfield, WI (US); Lowell B. Ziese, Pewaukee, WI (US); Jim Thomas, Lugoff, SC (US)

(73) Assignee: AAA Sales & Engineering, Inc., Oak Creek, WI (US)

( * ) Notice: Subject to any disclaimer, the term of this patent is extended or adjusted under 35 U.S.C. 154(b) by 0 days.

(21) Appl. No.: 13/295,888

(22) Filed: Nov. 14, 2011

(65) Prior Publication Data

US 2012/0055368 A1 Mar. 8, 2012

Related U.S. Application Data

(63) Continuation of application No. 12/247,810, filed on Oct. 8, 2008, now Pat. No. 8,079,309.

(51) Int. Cl.
*B61K 7/00* (2006.01)

(52) U.S. Cl.
USPC ..... 104/249; 104/256; 104/258; 104/259

(58) Field of Classification Search
USPC ..... 104/249, 252, 254, 257, 258, 259, 104/260
See application file for complete search history.

(56) References Cited

U.S. PATENT DOCUMENTS 2,175,286 A * 10/1939 Finch ..... 104/257
2,807,220 A * 9/1957 McDowell ..... 104/258
2,945,454 A * 7/1960 Beck ..... 104/259
3,128,721 A * 4/1964 McGowan ..... 104/162
3,215,091 A 11/1965 Hayes
3,807,532 A * 4/1974 Molt ..... 188/43
3,828,688 A * 8/1974 Bradbury ..... 104/252
3,924,539 A * 12/1975 Wladis ..... 104/258
3,944,174 A * 3/1976 Flinn ..... 246/163
4,080,904 A * 3/1978 Lofink et al. ..... 104/162
4,216,724 A 8/1980 Grillet
4,325,307 A * 4/1982 Bick ..... 104/256
4,480,723 A * 11/1984 Ingvast et al. ..... 188/62
4,498,561 A * 2/1985 Sanders ..... 188/36
4,739,863 A * 4/1988 Stauffer ..... 188/32
5,211,115 A * 5/1993 Maier et al. ..... 104/288
5,388,525 A * 2/1995 Bodkin ..... 104/26.2
5,836,252 A * 11/1998 Roick ..... 104/259
5,947,030 A * 9/1999 Spieldiener et al. ..... 104/250
6,152,042 A * 11/2000 Barry et al. ..... 104/26.2
6,155,178 A * 12/2000 Pease ..... 104/258
6,520,298 B1 * 2/2003 Meuters et al. ..... 188/62
6,773,221 B2 8/2004 Belongia et al.
7,717,043 B2 5/2010 Rastegar et al.
8,020,494 B2 9/2011 Smith et al.
8,079,309 B2 12/2011 Heyden et al.
2007/0062407 A1 * 3/2007 Kickbush ..... 104/249

(Continued)

*Primary Examiner* — Jason C Smith

(74) *Attorney, Agent, or Firm* — Andrus, Sceales, Starke & Sawall, LLP

(57) ABSTRACT

A device and system for controlling travel of a railcar along a set of rails is provided. In one example, a railcar stop is coupled to the set of rails and is selectively movable between a first position wherein the railcar is free to travel along the set of rails and a second position wherein the railcar stop engages the treads of the wheels to thereby prevent travel of the railcar in at least one direction along the rails.

9 Claims, 9 Drawing Sheets

U.S. PATENT DOCUMENTS

2009/0031914 A1 2/2009 Hahn et al.
2010/0083865 A1* 4/2010 Heyden et al. ..... 104/249
2011/0120340 A1 5/2011 Smith et al.
2011/0232521 A1* 9/2011 Heyden et al. ..... 104/249
2011/0265679 A1 11/2011 Smith et al.
2012/0012027 A1 1/2012 Thyssen, Jr.
2012/0055368 A1* 3/2012 Heyden et al. ..... 104/257

* cited by examiner

DEVICES AND SYSTEMS FOR CONTROLLING TRAVEL OF A RAILCAR

CROSS-REFERENCE TO RELATED APPLICATION

The present application is a continuation of co-pending U.S. patent application Ser. No. 12/247,810, filed Oct. 8, 2008, which application is incorporated herein by reference.

BACKGROUND AND SUMMARY

This application relates to devices and systems for controlling travel of a railcar. More particularly, this application relates to railcar stop devices and related systems for controlling travel of one or more railcars on a set of rails on for example a sloped surface in a railway classification yard. In one example, a system and device includes a pair of railcar stops that are coupled to a set of rails and selectively movable between a first position wherein the railcar is free to travel along the rails and a second position wherein the stops are configured to engage the treads of the railcar wheels to thereby prevent travel of the railcar in at least one direction along the rails. The stops can be actuated for example by a motor and can be configured to move parallel to the rails when the wheels engage with the stops. A shock absorber can be configured to bias the railcar stops against the force of the wheels and to absorb the force applied to the stops by the wheels. A controller and related user input device for controlling movement of the stops can also be provided. The pair of railcar stops can include a derailer mechanism for derailing the railcar should the railcar stop fail to impede travel of the railcar in the at least one direction along the rails.

BRIEF DESCRIPTION OF THE DRAWINGS

The best mode of practicing the invention is described with reference to the following drawing figures.

DETAILED DESCRIPTION OF THE DRAWINGS

In the following description, certain terms have been used for brevity, clearness and understanding. No unnecessary limitations are to be implied therefrom beyond the requirement of the prior art because such terms are used for descriptive purposes only and are intended to be broadly construed. The different devices and systems described herein may be used alone or in combination with other devices and systems. It is to be expected that various equivalents, alternatives and modifications are possible within the scope of the appended claims.

Figure 1:
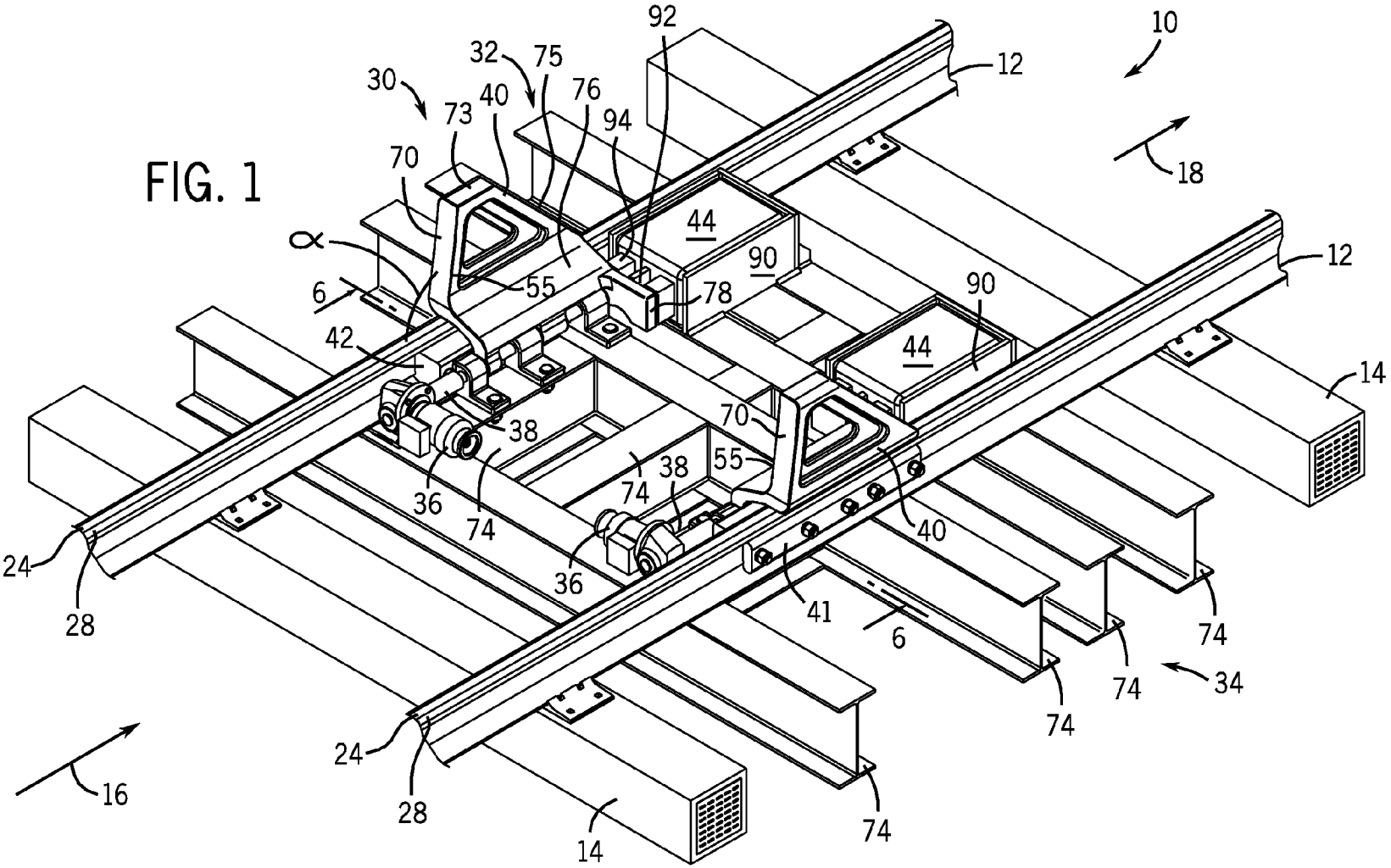
FIG. 1 is a perspective view of a section of railroad tracks and a device and system for controlling travel of a railcar.

FIG. 1 depicts a section of railroad tracks 10 that includes a pair of conventional rails 12 mounted on railroad ties 14. The rails 12 continue in both directions with railcars entering the section of tracks 10 in the direction of arrow 16 and exiting the section of tracks 10 in the direction of arrow 18. This type of arrangement is conventional and well known in the art. Railcars typically include sets of wheels, an example of one of which is shown schematically in FIG. 3 at 20. Each wheel 20 includes a tread 22 that is configured to ride along the top surface 24 of one of the rails 12. Each wheel 20 further includes a flange 26 that extends transversely outwardly from the tread 22. The flange 26 is configured to to engage the inner side surface 28 of the respective rail 12. This type of railcar wheel is conventional and known in the art.

FIG. 1 also depicts a device 30 mounted to the tracks 10 for controlling travel of a railcar along the rails 12. The device 30 includes two railcar stops 32, 34, which are substantially mirror images of each other and are positioned adjacent to each other between the rails 12. Each railcar stop 32, 34 includes a motor 36 that is configured to cause clockwise and counter-clockwise rotation of a connecting pin 38, a wing 40 that is connected to and rotates as the connecting pin 38 rotates, a mounting block 42 and backing member 41 connecting the connecting pin 38 and wing 40 to the rail 12, and a shock absorber 44.

Figure 2:
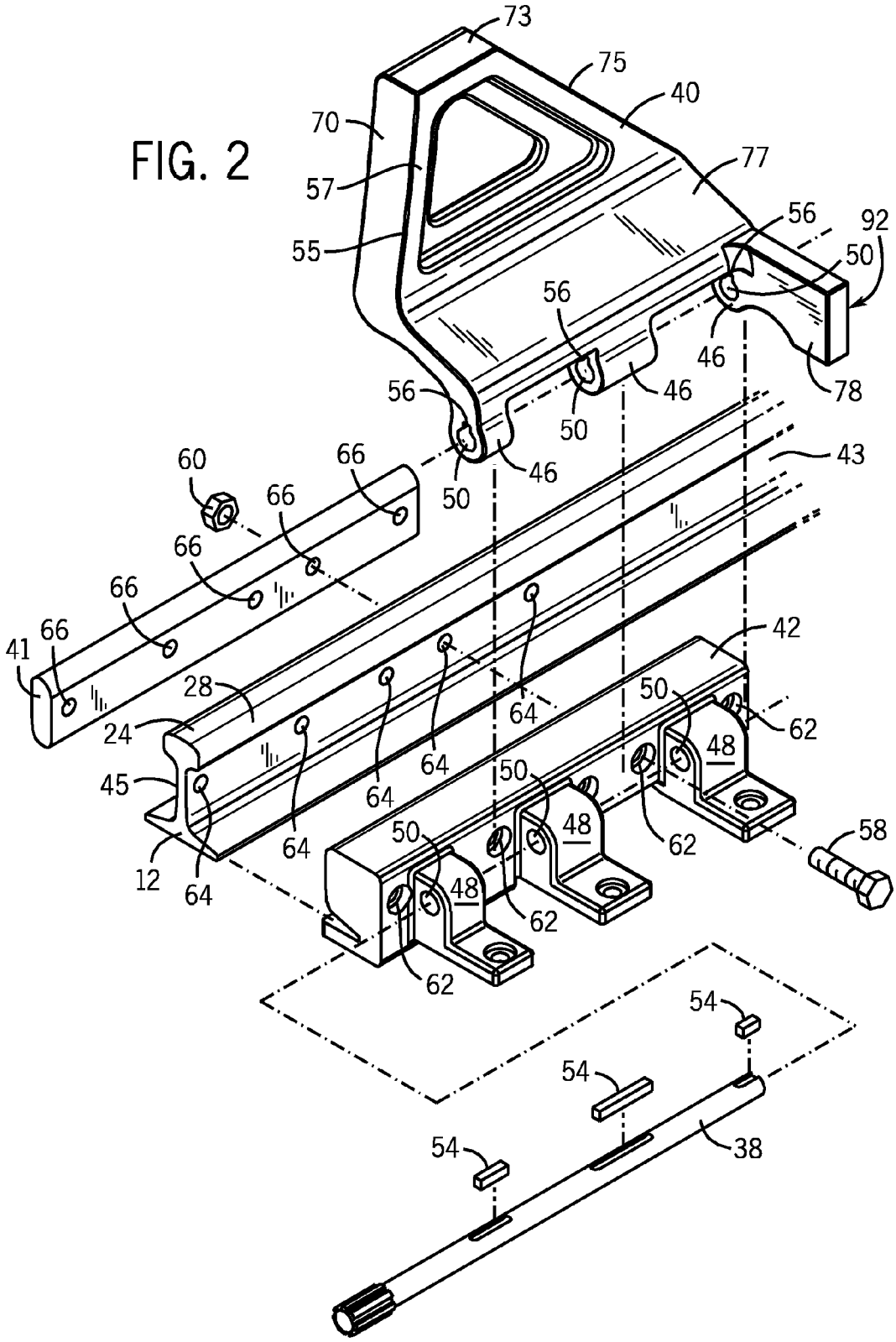
FIG. 2 is a perspective exploded view of a wing associated with a railcar stop shown in FIG. 1.
Figure 9:
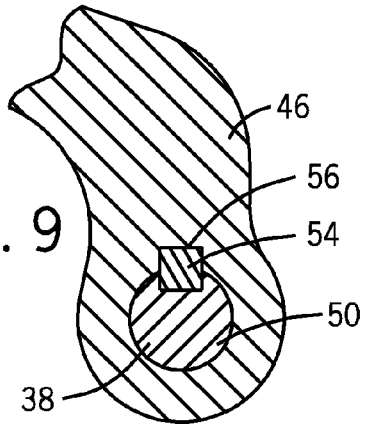
FIG. 9 is a view of a keyed connection between a wing and connecting pin associated with the railcar stop.

FIG. 2 shows an example of the wing 40 and mounting block 42 for the stop 32 in more detail. The wing 40 is connected to the mounting block 42 by a hinged connection. Specifically, the wing 40 includes a series of aligned, downwardly extending knuckles 46, which are sized and shaped to fit between corresponding knuckles 48 on the mounting block 42 in an interdigitated alignment. Each of the knuckles 46, 48 has a through-hole 50 configured such that when the knuckles 46, 48 are aligned and interdigitated, the through-holes 50 define a through-way sized and shaped to receive the connecting pin 38. A series of keys 54 are embedded in spaced alignment in the connecting pin 38. As shown in FIG. 9, the keys 54 are configured to engage corresponding key slots 56 formed in the through-holes 40 of the knuckles 46 when the connecting pin 38 is threaded into the aligned through-holes 50. The wing 40 and connecting pin 38 thus rotate together in unison about a longitudinal hinge axis defined by the connecting pin 38.

Figure 4:
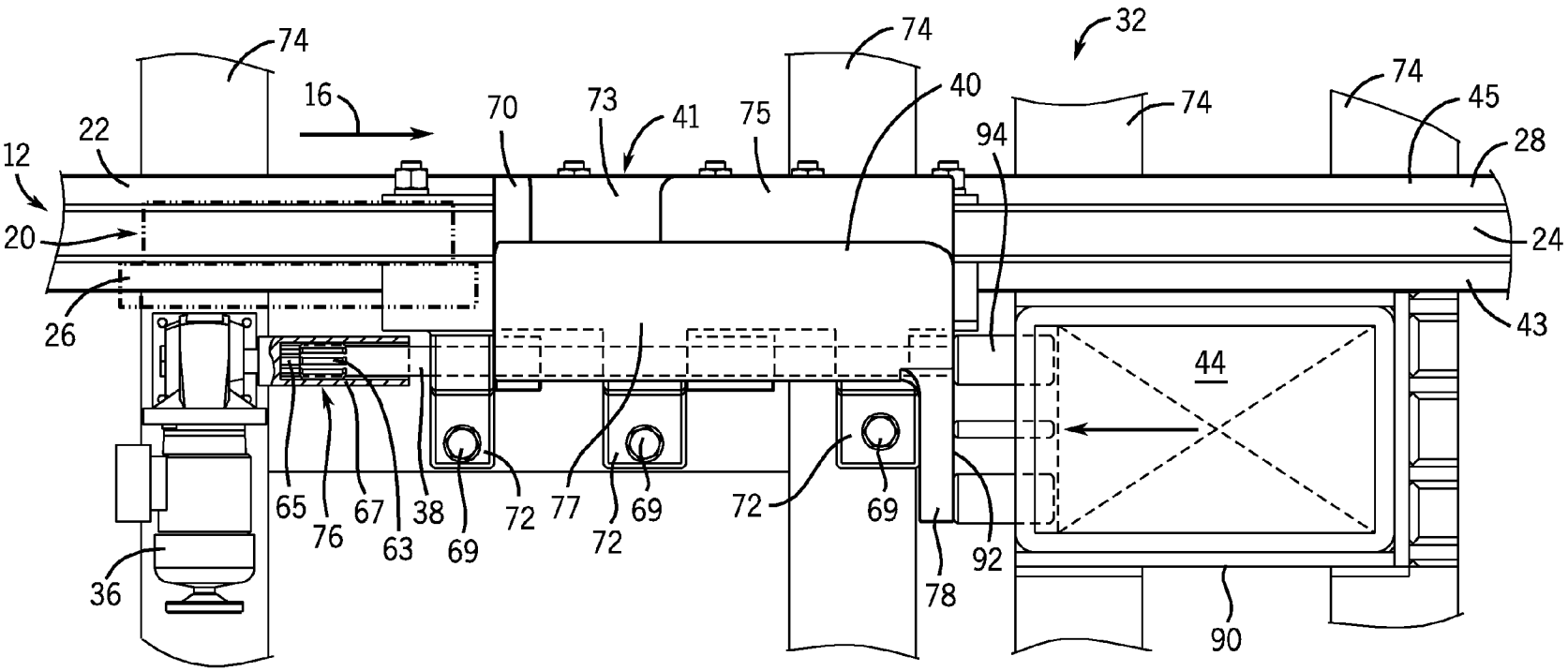
FIG. 4 is a top view of one of the rails and railcar stops shown in FIG. 1, wherein a railcar wheel is shown approaching the railcar stop.
Figure 5:
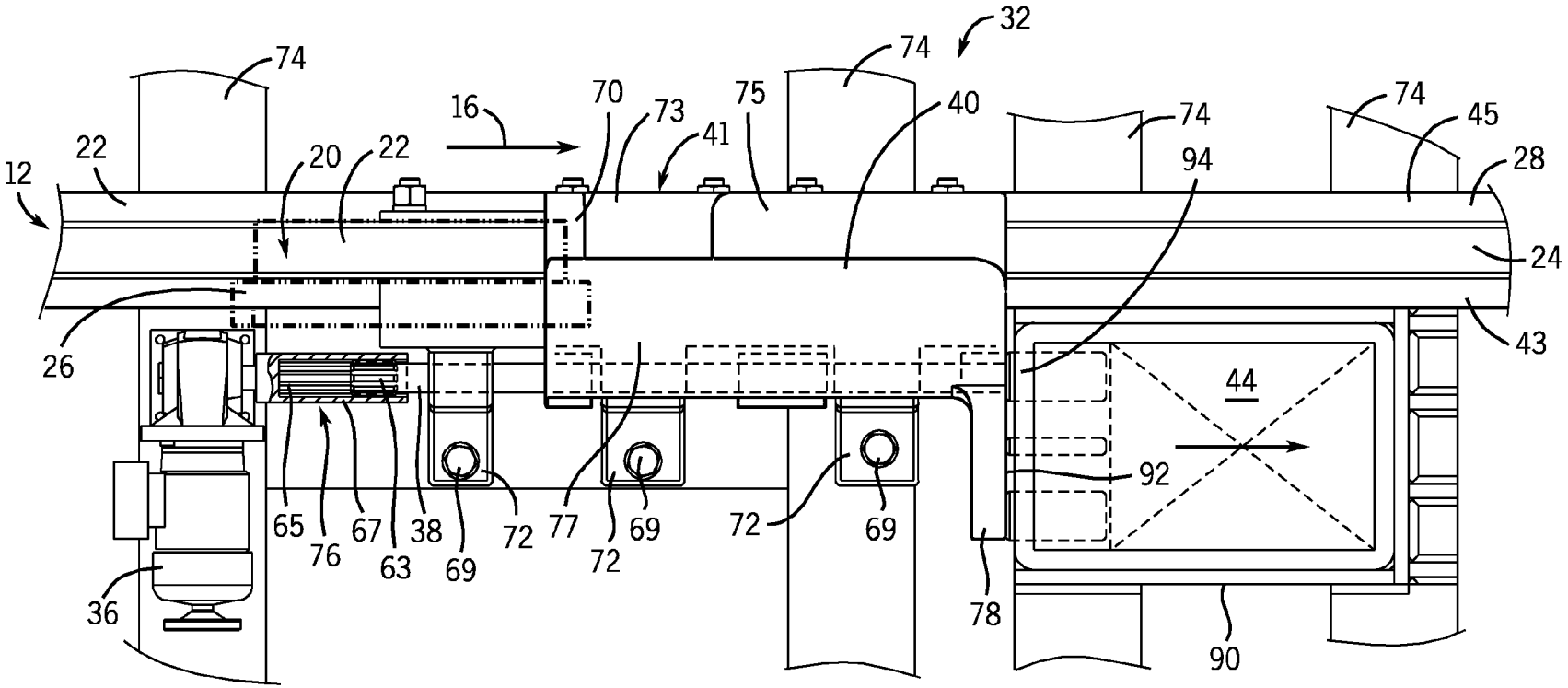
FIG. 5 is a top view of one of the rails and railcar stops shown in FIG. 1, wherein a railcar wheel is shown engaged with the railcar stop.

As shown in FIG. 2, the mounting block 42 is fixedly connected to the inside surface 43 of rail 12 by a plurality of bolts and nuts, examples of which are shown at 58 and 60, respectively. Bolts 58 are threaded through aligned apertures, namely apertures 62 formed in the mounting block 42, apertures 64 formed in the rail 12, and apertures 66 formed in the backing member 41, which is located adjacent the outside surface 45 of rail 12. Thereafter nuts 60 are screwed onto the threaded end of the bolts 58 to secure the block 42 and backing member 41 to the rail 12. As shown in FIGS. 4 and 5, additional bolts 69 are threaded through flanges 72 that extend outwardly from knuckles 48. For stability, the bolts 69 are secured to one or more I-beams 74 (see FIG. 1) mounted beneath the rails 12.

As shown in FIGS. 1 and 2, each wing 40 includes a bearing face 70 that is oriented transversely relative to the connecting pin 38 and offset from the connecting pin 38 by a certain distance so that when the wing 40 is oriented in a raised position, as shown in FIG. 1, the bearing face 70 is aligned on top of and forms an angle α (see FIG. 1) with the top surface 24 of the rail 12. In one example, the angle α is slightly larger than 90 degrees. In other examples the angle α could be equal to or less than 90 degrees. The particular angle between the bearing face 70 and the top surface 24 of the rail 12 is not critical as long as the bearing face 70 is able to suitably engage with the tread 22 of the wheel 20, as will be described further below. In the example shown, the wing 40 is generally triangular in shape and includes the bearing face 70, a flat top face 73 and a sloped front face 74. The laterally offset relationship between the bearing face 70 and the connecting pin 38 is facilitated by an intermediate portion 77 which in the example shown is curved and integrally connects the knuckles 46 and bearing face 70. A flange 78 extends from the wing 40 transversely relative to the bearing face 70 and transversely relative to the connecting pin 38. The purpose of the flange 78 will be further discussed herein below.

As shown in FIGS. 1, 4 and 5, the motor 36 is connected to the connecting pin 38. Operation of the motor 36 by, for example, a worm drive (not shown) causes the connecting pin 38 to rotate about its longitudinal axis. The motor 36 can include an electric motor, hydraulic motor and/or the like. In the example shown, the motor 36 is connected to the connecting pin 38 by a spline coupling 76, details of which are shown in FIGS. 4 and 5. The spline coupling 76 facilitates movement of the pin 38 and wing 40 longitudinally relative to the rails 12 in both forward and backward directions, as will be discussed further below. Specifically, the spline coupling 76 includes radially outwardly extending fingers 63 on the pin 38, which are fitted in corresponding longitudinally extending channels 65 on a splined sleeve 67. Rotation of the splined sleeve 67 by motor 36 and engagement between the fingers 63 and splined sleeve 67 causes corresponding rotation of shaft 38. In addition, the fingers 63 are free to move longitudinally along the splined sleeve 67, thus allowing the shaft 38 and attached wing 40 to move longitudinally along the rail 12 a distance defined by the longitudinal length of sleeve 67.

The shock absorber 44 is contained within a housing 90 that is mounted to one or more of the I-beams 74 for stability. In one example, the shock absorber 44 includes a railroad draft gear, however the shock absorber could include any other type of device designed to absorb shock, such as a railcar cushion unit, industrial shock absorber, or the like. The shock absorber 44 is situated such that when the wing 40 is positioned in the raised position shown in FIG. 1, the front surface 92 of flange 78 is positioned adjacent to a receiving end 94 of the shock absorber 44.

Figure 10:
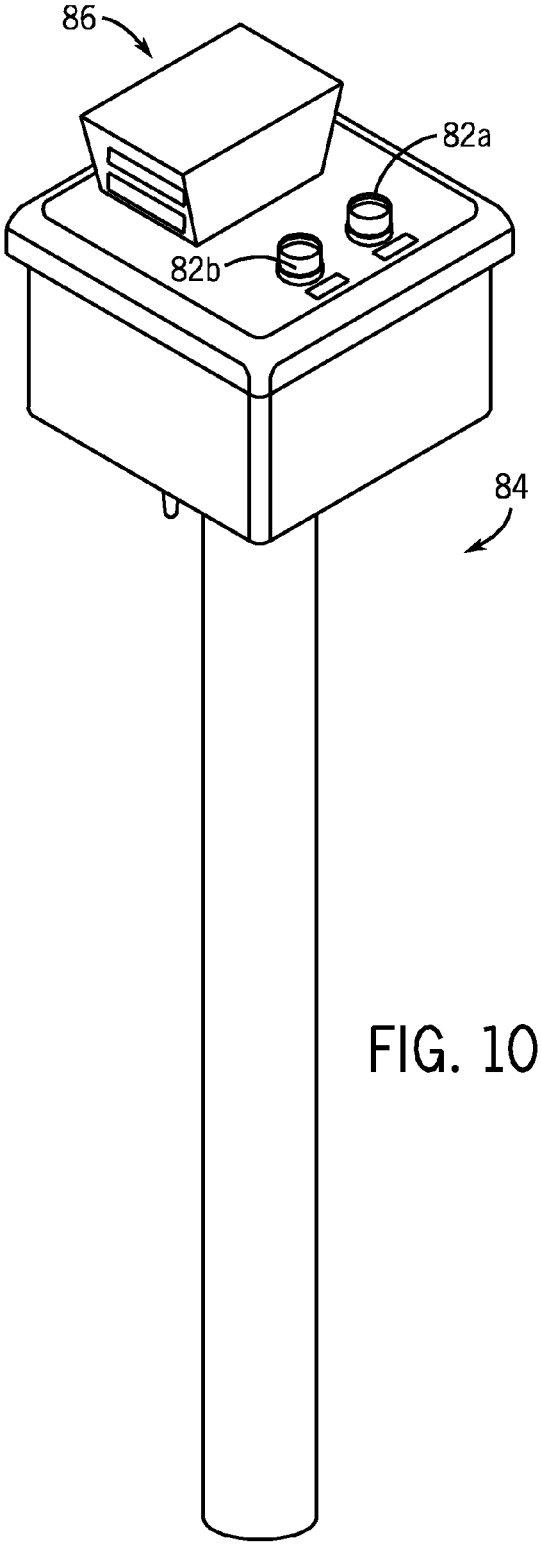
FIG. 10 is a perspective view of a control pedestal.
Figure 11:
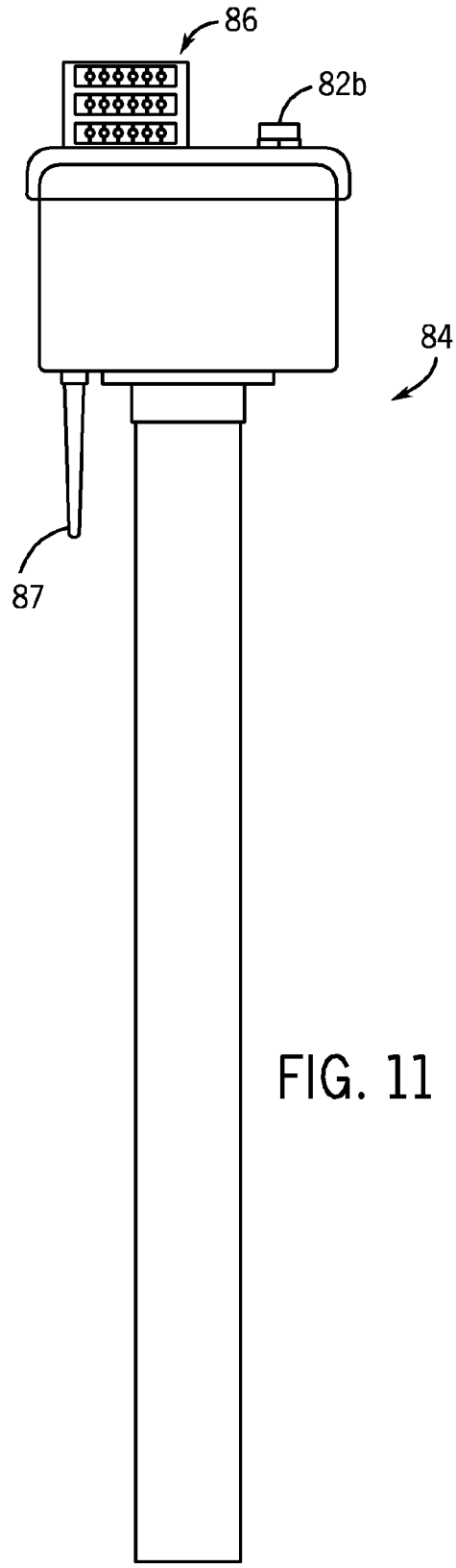
FIG. 11 is a side view of the control pedestal in FIG. 10.

Operational control of the device 30 is provided by a controller having a microprocessor programmed to actuate the motor 36. FIGS. 10 and 11 show one example wherein the controller and microprocessor are contained within a control pedestal 84, which can be located proximate to the device 30. In other examples, the controller and microprocessor can be located at a remote location, such as a control tower at a railroad classification yard. Alternately, user control can be provided both at the control pedestal 84 and at the remote location.

In the example shown, the control pedestal 84 includes user input devices, such as switches 82*a* and 82*b*, which are operable to actuate the motor 36. In one example, the switch 82*a* can open or close communication from the remote location. This feature allows a user to manually allow or disallow control from the remote location. Operation of switch 82*b* can activate the motor 36. The control pedestal 84 also includes a light assembly 86 and/or other visible, audible or tactile device for communicating conditions of the device 30. In the example shown, the light assembly 86 includes yellow lights for indicating that the device 30 is in the raised position (FIG. 6), green lights for indicating that the device 30 is in the lowered position (FIG. 7), and red lights for indicating that the device 30 is in a fault mode, for example wherein one of the wings 40 are not in the position inputted by the user via for example the control switch 82*b*. An antenna 87 is provided on the pedestal 84 for communicating wirelessly to the device 30 and/or for communicating wirelessly to the remote location, such as the control tower. In another example, the control pedestal 84 can include a solar panel (not shown) and/or a backup battery (not shown) for providing power to the controller, light assembly 86, motor 36, etc. A proximity switch can be provided on the device 30 and placed in communication with the controller. The proximity switch can be programmed to verify whether the position of the wings 40 accords with a command sent from the controller. In such an arrangement, the controller could include a comparator for comparing whether the sensed position of the wings 40 accords with the user input command. If the two parameters do not accord the aforementioned fault mode is indicated by an alarm that is audible and/or visible, such as the red lights.

Figure 7:
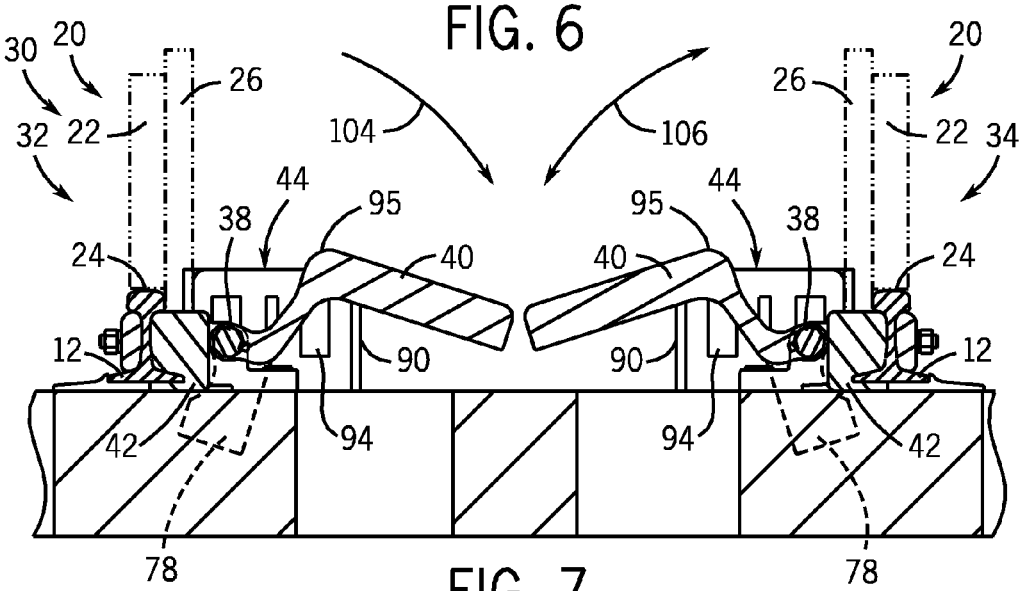
FIG. 7 is a view of section 6-6 taken in FIG. 1, wherein the railcar stop is in a lowered position.

FIG. 7 shows the device 30 set in a lowered position wherein a railcar is allowed to freely travel through the section of railroad tracks 10 in the direction of arrows 16, 18 and/or opposite of arrows 16, 18. In the lowered position, the wings 40 are rotated inward towards each other about the longitudinal axis defined by connecting pin 38. In the lowered position, the uppermost portion 95 of the wings 40 is positioned below the lowest clearance point on the underside of the railcar (not shown) to allow for free passage of the railcar over the device 30.

Figure 6:
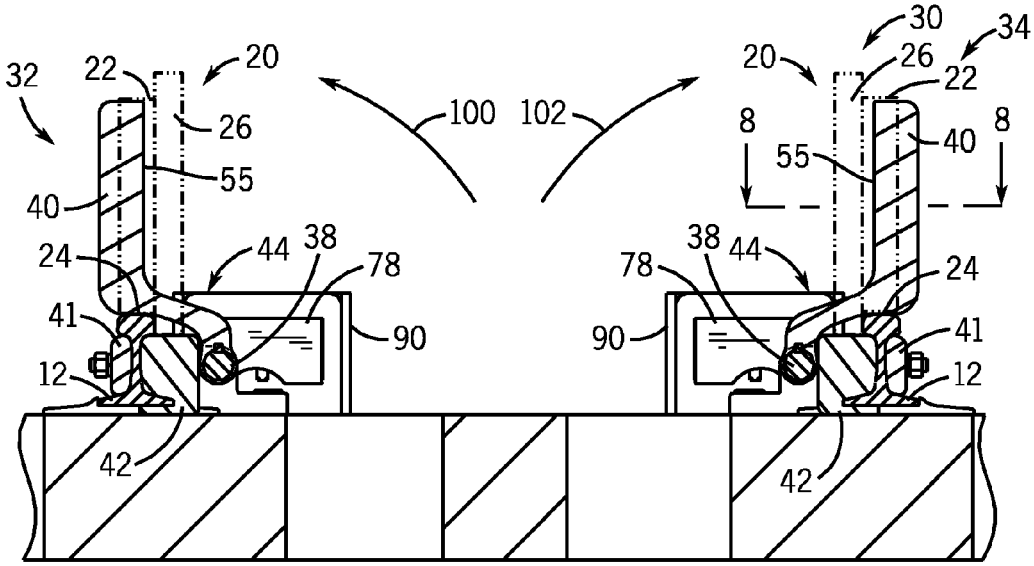
FIG. 6 is a view of section 6-6 taken in FIG. 1, wherein the railcar stop is in a raised position.

FIG. 6 shows the device 30 set in the raised position wherein the railcar stops 32, 34 are configured to engage the treads 22 of the railcar wheels 20 to thereby prevent travel of the railcar along the section of tracks 10 in the direction of arrows 16, 18. During operation, the device 30 is moved from the lowered position (FIG. 7) to the raised position (FIG. 6) as follows. An actuating signal is emitted from controller 80 to the motors 36 via the link 79 to initiate operation of motor 36. The motors 36 causes the connecting pins 38 to rotate towards the respective rail 12 to which the respective pin 38 is coupled, as shown at arrows 100, 102. As the connecting pin 38 rotates, the respective wing member 40, which is coupled to the connecting pin 38 via the keyed connection (FIG. 9) also rotates accordingly. Once the bearing surface 70 of the wing members 40 are both positioned over and adjacent to the top surface 24 of the corresponding rail 12 to which the wing member 40 is coupled, the railcar stop 32, 34 is fully rotated into the raised position. As the wing member 40 is rotated, the flange 78, which is fixedly connected to the wing 40 is also rotated. In the raised position, the flange 78 is positioned so that its outer surface 92 is adjacent to receiving end 94 of the shock absorber 44.

FIGS. 4 and 5 show the railcar stop 32 in the raised position just prior to engagement with a railcar wheel 20 and just after engagement with a railcar wheel 20, respectively. In FIG. 4, the railcar stop 32 is positioned in the raised position so that outer surface 92 of flange 78 is positioned adjacent the receiving end 94 of the shock absorber 44. The wheel 20 is approaching the railcar stop 32 but has not yet engaged the railcar stop 32. As shown in FIG. 5, when the tread 22 of the railcar wheel 20 engages the bearing face 70 of the wing 44, the momentum of the wheel 20 pushes the wing 40 and connecting pin 38 longitudinally along the track 12 in the direction of arrow 16. The wing 40 and associated connecting pin 38 are allowed to move longitudinally along the length of the spline coupling 76. As the wing member 40 is forced longitudinally in the direction of arrow 16, the outer surface 92 of flange 78 engages the intake end 94 of shock absorber 44, thus allowing the shock absorber 44 to bias the railcar stop 32 in the direction opposite arrow 16. The shock absorber 44 absorbs the compressive pressure of the wheels 20 on the wing member 40 when the wheel 20 engages the railcar stop 32 in the forward direction 16 and stabilizes movement of the wing member 40 in the longitudinal direction.

Figure 3:
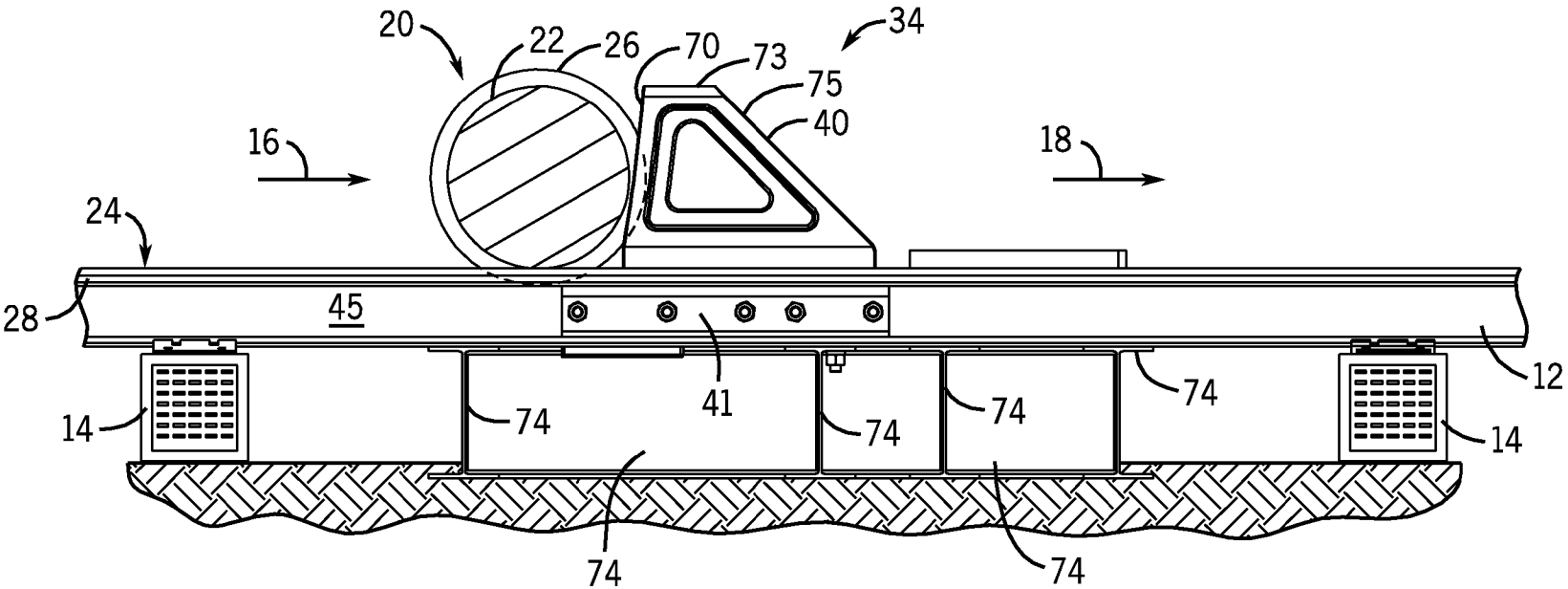
FIG. 3 is a side view of a railcar wheel engaged with a railcar stop shown in FIG. 1.
Figure 8:
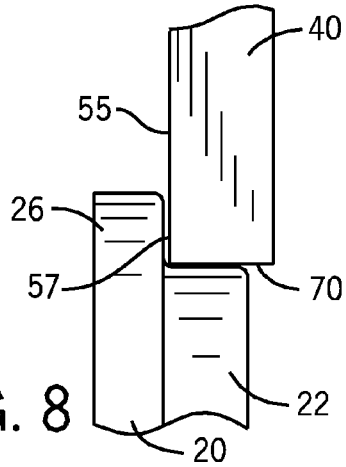
FIG. 8 is a view of section 8-8 taken in FIG. 6.

FIGS. 3, 5 and 8 show a railcar wheel 20 engaged with the bearing face 70 of a respective railcar stop 32, 34. As shown in FIG. 3, the railcar stop 34 engages tread 22 of the wheel 20 at a distance from the top surface 24 of the rails 12 that is substantially equal to the radius of the wheel 20. This is a preferred arrangement designed to prevent the wheel 20 from riding over the wing 40 and continuing along the rail 12. In addition, the flange 26, which extends radially outwardly from the tread 22, advantageously prevents the wing 40 from pivoting out of the upright position (FIG. 6) and into the retracted position (FIG. 7). That is, the engagement between the railcar stop 34, 36 and wheel 20 prevents the device 30 from accidentally retracting and allowing travel of the railcar 20. To move the wings 40 from the raised position to the lower position, it is necessary to move the railcar and associated wheels 20 a distance opposite the direction 16 that is greater than the width of the flange 26 so that the flange 26 clears the bearing face 70 of the wing 40 and the wing 40 is allowed to pivot into the downward position (FIG. 7). Otherwise, pivoting action of the wing 40 is prevented by the engagement between the flange 26 and wing 40 (FIG. 9). As shown in FIGS. 1, 3 and 6, the bearing face 70 has an inside edge 55 that is aligned with the rail 12 when the wing 40 is in the raised position (FIG. 6) so that the flange 26 on the railcar wheel 20 can pass by the bearing face 70 as the wheel tread 22 approaches the bearing face 70 (FIG. 3). The wing 40 also has an inner bearing surface 57 (FIG. 8) that is transversely oriented with respect to the bearing face 70 and faces the longitudinal hinge axis defined by the connecting pin 38 (FIGS. 1 and 2), such that when the wheel tread 22 is engaged with the bearing face 70 the inner bearing surface 57 engages with the flange 26 on the railcar wheel 20 and prevents the wing 40 from moving from the raised position (FIG. 6) to the lowered position (FIG. 7).

To move the device from the raised position (FIG. 6) to the lowered position (FIG. 7), a signal is emitted from controller to the motors 36 to initiate operation of the motors 36. The motors 36 operate to rotate the connecting pins 38. As the connecting pins 38 rotate, the respective wing members 40, which are coupled to the connecting pins 38 via the keyed connections (FIG. 9) rotates accordingly. In the view shown in FIG. 7, rotation of the connecting pins 38 in the respective directions arrow 104, 106 causes rotation of the wings 40 in the respective directions of arrow 104, 106. Once the uppermost portions 95 of the wings 40 are positioned beneath the travel path of the railcar, the railcar stops 32, 34 are fully rotated into the lowered position. As the wing members 40 are rotated, the flanges 78 which are fixedly connected to the wings 40 are also rotated.

The examples depicted in the drawing figures utilize spline coupling 76. However in an alternative arrangement, the motor 36 could be mounted on a sliding bed and the spline coupling 76 could be eliminated. In such an arrangement, the bed, motor 36, connecting pin 38 and wing 40 would slide together when engaged by the railcar wheel 20.

The depicted example shows one device 30 for controlling position and travel of a railcar along one section of track 10. It will be recognized by those skilled in the art, that a system could include two opposed devices 30 spaced apart along a section of tracks for controlling position and travel of a railcar in both forward and backward directions along the tracks. In addition, a plurality of devices 30 could be aligned in series to position and control travel of railcars at various increments along an extended section of track 10.

Figure 12:
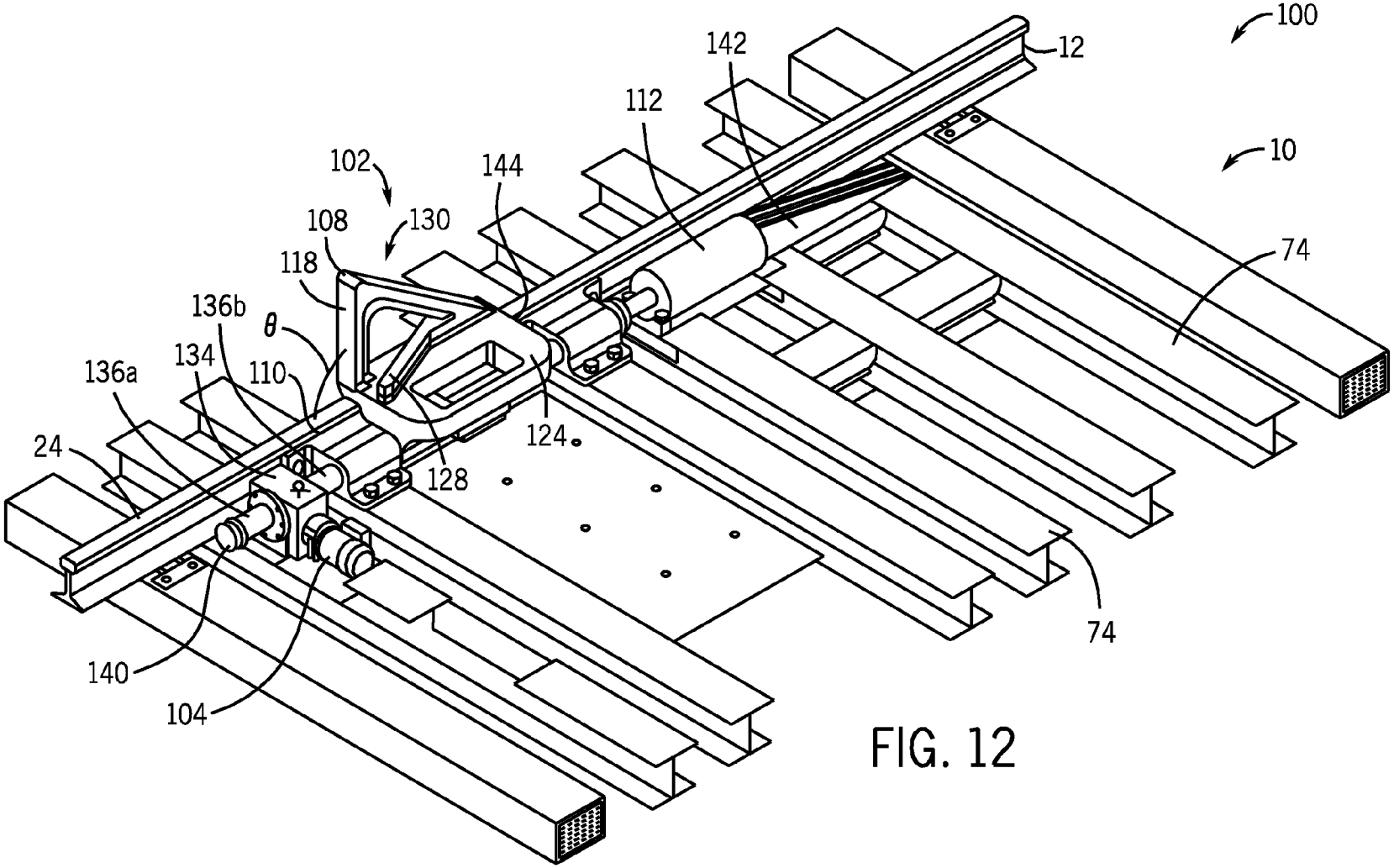
FIG. 12 is a perspective view of a section of railroad tracks and a second embodiment of a device and system for controlling travel of a railcar.
Figure 13:
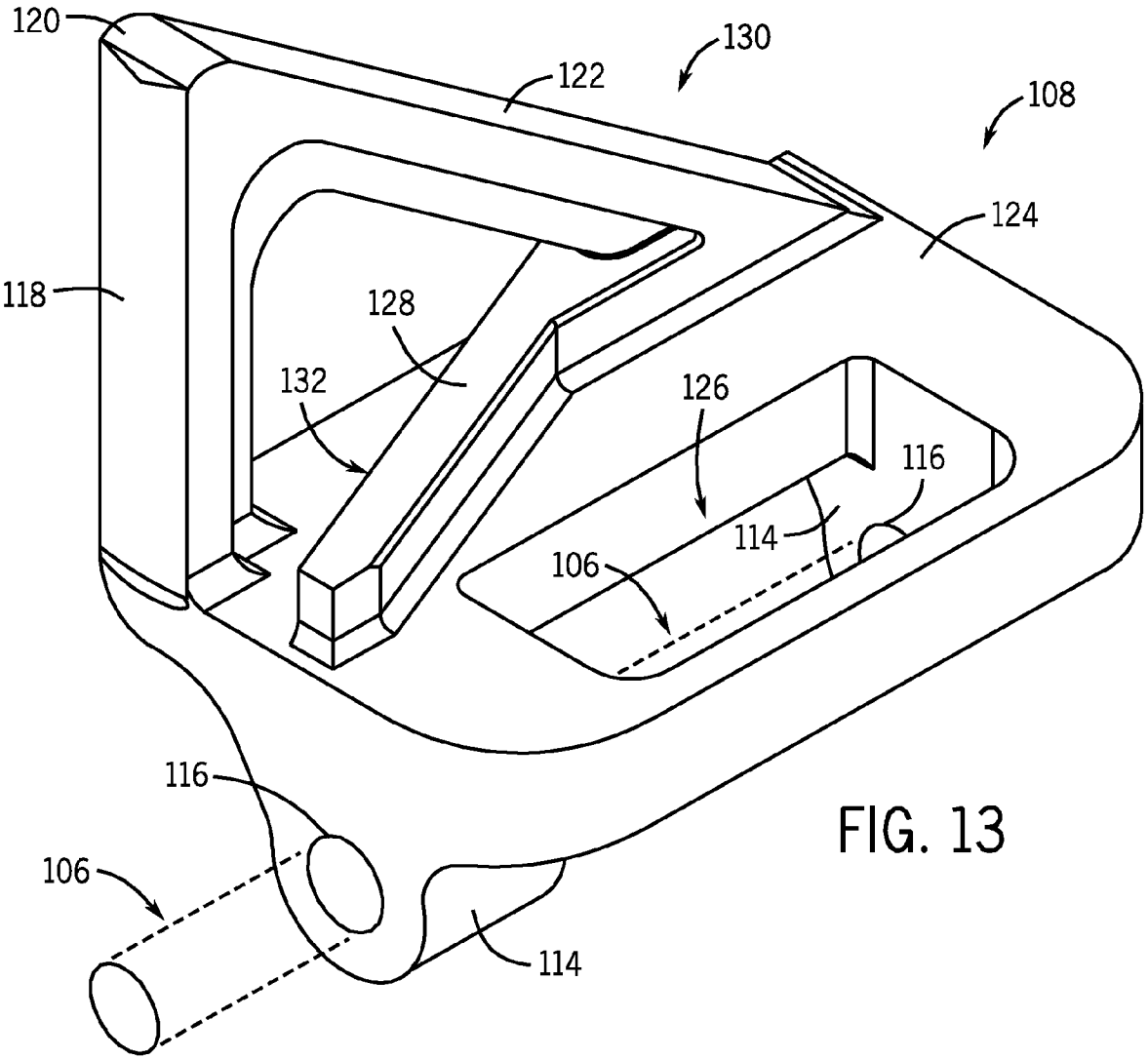
FIG. 13 is a perspective view of a wing associated with a railcar stop shown in FIG. 12.

FIGS. 12 and 13 depict another example of a device 100 mounted to tracks 10 for controlling travel of a railcar along rails 12. Similar to the arrangement of FIG. 1, the device 100 includes two similarly constructed, opposed railcar stops, only one of which is shown in FIG. 12 at 102. The railcar stop 102 includes a motor 104 that is configured to cause clockwise and counterclockwise rotation of a connecting pin 106, a wing 108 that is connected to and rotates as the connecting pin (shown figuratively at arrow 106 in FIG. 13) rotates, a mounting block 110 connecting the connecting pin 106 and wing 108 to the rail 12, and a shock absorber 112.

FIG. 13 shows an example of the wing 108 for the stop 102 in more detail. The wing 108 is connected to the mounting block 110 by a hinged connection. Specifically, the wing 108 includes two aligned downwardly extending knuckles 114, which are sized and shaped to fit between corresponding knuckles in the mounting block 110 in an interdigitated alignment. Each of the knuckles 114 has a through-hole 116 configured such that when the knuckles 114 are aligned and interdigitated with the corresponding knuckles on the mounting block 110, the through-holes 116 in the respective knuckles define a through-way sized and shaped to receive the connecting pin 106. As with the embodiment shown in FIGS. 1-8, the connecting pin 106 and wing 108 are interconnected, such as by a keyed arrangement (not shown). The wing 108 and connecting pin 106 thus rotate together in unison about a longitudinal hinge axis defined by the connecting pin 106.

The wing 108 includes a bearing face 118 that is oriented transversely relative to the connecting pin 106 and offset from the connecting pin 106 by a certain distance such that when the wing 108 is oriented in a raised position, as shown in FIG. 12, the bearing face 118 is aligned on top of and forms an angle θ (see FIG. 12) with the top surface 24 of the rail 12. In one example, the angle θ is slightly larger than 90°. In other examples, the angle θ could be equal to or less than 90°. The particular angle between the bearing face 118 and the top surface 24 of the rail 12 is not critical as long as the bearing face 118 is able to suitably engage with the tread 22 of the wheel 20, as described above. In the example shown, the wing 108 has a generally triangular shape 130 and includes the bearing face 118, a top face 120 and a sloped front face 122. The laterally offset relationship between the bearing face 118 and the connecting pin 106 is facilitated by an intermediate portion 124 which in the example shown is relatively flat and integrally connects the knuckles 114 and bearing face 118. The intermediate portion 124 differs from the intermediate portion 77 shown in FIG. 2 and by comparison has been found to provide increased axial strength to the wing 108. An aperture 126 is provided in the intermediate portion 124 to save material, cost, lessen weight, and provide access to the underlying interdigitated knuckle connection.

The wing 108 includes a derailer mechanism 128 configured to cause derailing of the railcar wheel 20 upon failure of the railcar stop 102. In the example shown, if the load from the railcar wheel 20 exceeds a predetermined design capacity, the triangular shape 130 of the wing 108 will break off, leaving the substantially flat intermediate portion 124 over the head of the rail 12. The derailer mechanism 128 includes a substantially vertical rib 132, which runs over the rail 12 at an angle when the wing 108 is in the raised position. The rib 132 is configured to engage with the flange 26 on the wheel 20 and guide the wheel 20 off the rail 12, thus derailing the railcar. This feature advantageously prevents greater damage that could be caused by a railcar that is traveling at dangerously high speeds.

In one example, a combination of two wings 40, one on each rail 12, can be designed to support a load of 600,000 lbf (i.e. 300,000 lbf per wing). If the load from the railcar exceeds this amount, the vertical triangular shape 130 of the wing 40 will shear off, thus leaving the substantially flat intermediate member 124 over the head of the rail 12. As described above, the derailer mechanism 128 will thus cause the railcar to derail. In this example, the device 102 is designed to absorb single 286,000 lbf gross weight railcar impacts at three mph without exceeding the predetermined force threshold. In this example, the device 102 can prevent railcars that are resting against it from moving downhill, however, it also anticipates that the railcars may not be perfectly positioned. Minor impacts may occur, which are accommodated by the design.

As shown in FIG. 12, the motor 104 includes a hollow shafted gearbox 134 that is connected to the connecting pin 106 via a keyed arrangement. Specifically, the gearbox 134 includes a rotatable hollow tube connected to the connecting pin 106 via a keyed arrangement such that rotation of the tube causes rotation of the connecting pin 106. Outer pipe sections 136*a*, 136*b* are provided on the connecting pin, along with an outer flange and cap arrangement 140. The pipes 138*a*, 138*b* can be filled with oil to provide lubrication and protection during use of the device 100 in for example cold, or otherwise harsh environments. This arrangement obviates the need for the spline coupling described with regards to the embodiment shown in FIG. 1.

The shock absorber 112 is mounted to one or more I-beams 74 for stability via a plurality of gussets 142. In the example shown, the shock absorber 112 includes a hydraulic cushion unit or industrial hydraulic shock absorber, or the like. The shock absorber 112 is situated such that when the wing 108 is positioned in the raised position shown in FIG. 12, the front surface 144 of intermediate portion 124 engages an outer tube 146 intermediate the shock absorber 112 and wing 108.

The device 100 functions largely the same as device 30 described hereinabove. As discussed above, operation of motor 104 causes rotation of the connecting pin 106, which in turn causes raising and/or lowering of the wing 108 depending upon the direction of rotation. The shock absorber 112 receives and cushions axial force applied to the wing 108 by the railcar wheel 20.

What is claimed is:

1. A device for stopping travel of a railcar that rides along a pair of rails, the railcar having a plurality of wheels, each wheel in the plurality of wheels having a wheel tread that rides along one rail of the pair of rails and having a flange that radially outwardly extends from the wheel tread, the device comprising:

a wing that is pivotable about a longitudinal hinge axis that extends parallel to one rail of the pair of rails, the wing being pivotable between a raised position wherein the wing prevents travel of the railcar along the pair of rails and a lowered position wherein travel of the railcar along the pair of rails is permitted, the wing comprising a bearing face that is transversely oriented relative to the longitudinal hinge axis and is offset from the longitudinal hinge axis so that when the wing is oriented in the raised position, the bearing face is aligned on top of the one rail and engages with the wheel tread of one wheel in the plurality of wheels;

wherein the bearing face has an inside edge that is aligned with the one rail when the wing is in the raised position so that the flange on the railcar wheel can pass by the bearing face as the wheel tread approaches the bearing face; and wherein the wing further comprises an inner bearing surface that is transversely oriented with respect to the bearing face and faces the longitudinal hinge axis, such that when the wheel tread is engaged with the hearing face, the inner bearing surface engages with the flange on the railcar wheel and prevents the wing from moving from the raised position to the lowered position.

2. The device according to claim 1, wherein the wing is one of a pair of wings that are oppositely oriented with respect to each other and disposed between the pair of rails, each wing being pivotable into raised positions above one of the rails in the pair of rails and lowered positions between the pair of rails.

3. The device according to claim 1, comprising a connecting pin that extends along the longitudinal hinge axis, wherein the wing is coupled to the connecting pin such that rotation of the connecting pin causes pivoting movement of the wing.

4. The device according to claim 3, comprising a mounting block for the wing, the mounting block comprising a plurality of spaced apart knuckles and the wing comprising a plurality of spaced apart knuckles that are interdigitated and aligned with the plurality of spaced apart knuckles on the mounting block, wherein the connecting pin extends through the pluralities of spaced apart knuckles of the wing and mounting block.

5. The device according to claim 4, comprising a series of keys that are in spaced alignment with the connecting pin and that engage the wing with the connecting pin so that rotation of the connecting pin causes pivoting movement of the wing.

6. The device according to claim 4, wherein the wing comprises an intermediate portion that connects the plurality of spaced apart knuckles of the wing and the bearing face.

7. The device according to claim 6, wherein the intermediate portion is curved.

8. The device according, to claim 6, wherein the intermediate portion is flat.

9. The device according, to claim 3, comprising a motor coupled to the connecting pin to rotate the connecting pin about the longitudinal axis.

* * * * *